US007066446B2

(12) United States Patent
Nielsen

(10) Patent No.: US 7,066,446 B2
(45) Date of Patent: Jun. 27, 2006

(54) HYDRAULIC VALVE ARRANGEMENT

(75) Inventor: Brian Nielsen, Soenderborg (DK)

(73) Assignee: Sauer-Danfoss ApS, Nordborg (DK)

( * ) Notice: Subject to any disclaimer, the term of this patent is extended or adjusted under 35 U.S.C. 154(b) by 79 days.

(21) Appl. No.: 10/945,333

(22) Filed: Sep. 20, 2004

(65) Prior Publication Data

US 2005/0072954 A1 Apr. 7, 2005

(30) Foreign Application Priority Data

Sep. 24, 2003 (DE) ..... 103 44 480

(51) Int. Cl.
*F15B 21/08* (2006.01)

(52) U.S. Cl. ..... 251/321; 251/324; 251/129.08

(58) Field of Classification Search ..... 251/129.08, 251/321, 324
See application file for complete search history.

(56) References Cited

U.S. PATENT DOCUMENTS 3,170,376 A * 2/1965 Cudnohufsky ..... 91/22
4,065,922 A * 1/1978 Ott et al. ..... 60/445
4,194,534 A * 3/1980 Lawrence et al. ..... 137/625.39
5,568,759 A 10/1996 Aardema
6,477,026 B1 * 11/2002 Lemke ..... 361/152
6,837,045 B1 * 1/2005 Heusser ..... 60/403
2003/0078697 A1 4/2003 Kockemann
2005/0098755 A1 * 5/2005 Kussel ..... 251/324

FOREIGN PATENT DOCUMENTS

DE 3810111 10/1989
DE 4314801 11/1994
EP 0 809 737 B1 6/1999

* cited by examiner

*Primary Examiner*—J. Casimer Jacyna
(74) *Attorney, Agent, or Firm*—McCormick, Paulding & Huber LLP

(57) ABSTRACT

A hydraulic valve arrangement with a first and a second working connection, both working connections being connectable with a hydraulic consumer, a supply connection having a pressure connection and a tank connection, a first valve, which closes the pressure connection or connects it in a controlled manner with the first working connection or the second working connection, a second valve, which closes the tank connection or connects it in a controlled manner with the first or the second working connection, and a control device, which controls the first valve and the second valve. It is endeavored to enable a simple manner of exact controlling the consumer. For this purpose, at least one valve is provided with an opening degree sensor, which is connected with the control device, the control device controlling the valve arrangement in dependence of the signal from the opening degree sensor and a specified signal.

16 Claims, 2 Drawing Sheets

HYDRAULIC VALVE ARRANGEMENT

CROSS-REFERENCE TO RELATED APPLICATIONS

This application is entitled to the benefit of and incorporates by reference essential subject matter disclosed in German Patent Application No. 103 44 480.7 filed on Sep. 24, 2003.

FIELD OF THE INVENTION

The invention concerns a hydraulic valve arrangement with a working connection arrangement having a first working connection and a second working connection, both working connections being connectable with a hydraulic consumer, a supply connection arrangement having a pressure connection and a tank connection, a first valve arrangement, which closes the pressure connection or connects it in a controlled manner with the first working connection or the second working connection, a second valve arrangement, which closes the tank connection or connects it in a controlled manner with the first working connection or the second working connection, and a control device, which controls the first valve arrangement and the second valve arrangement.

BACKGROUND OF THE INVENTION

Such a hydraulic valve arrangement is known from U.S. Pat. No. 5,568,759. A control lever or a joystick provides a specified signal to a microprocessor, which activates pilot valves for both valve arrangements, the slide of said pilot valves being connected via springs with the slide of the valve arrangement concerned, so that a spring-controlled interaction occurs. In many cases, this embodiment is advantageous in that the flow through both valve arrangements takes place only in one direction, so that the forces acting upon the valve elements are substantially independent of the working direction of the consumer. However, it is difficult to achieve an accurate control of the consumer with this valve arrangement, as friction in the mechanical parts, hysteresis in the solenoid valves and external forces, for example forces originating from the flow, prevent an exact positioning of the slide.

The invention is based on the task of providing a simple manner of enabling an exact control of the consumer.

SUMMARY OF THE INVENTION

With a valve arrangement as mentioned in the introduction, this task is solved in that at least one valve arrangement is provided with an opening degree sensor, which is connected with the control device, the control device controlling the valve arrangement in dependence of the signal from the opening degree sensor and a specified signal.

By means of the opening degree sensor, the control device can determine the amount of fluid supplied to or discharged by the consumer, depending on whether the opening degree sensor is located in the first or in the second valve arrangement. By means of this opening degree, the movement or the movement speed, respectively, and thus also the position of the consumer, can be controlled relatively accurately.

Preferably, the valve arrangement has the form of a slide valve, and the opening degree sensor is a position sensor, which determines a position of a slide. Thus, the opening degree is no longer determined directly. As, however, a certain opening degree is allocated to each position of the slide, the position of the slide permits an indirect determination of the opening degree. A Hall-sensor, an LVDT (linear variable differential transducer) or any other suitable sensor can be used as position sensor.

It is advantageous that the control device considers a non-linear correlation between the position of the slide and the opening degree of the valve arrangement. Such a correlation can, for example, be stored as a function or as a table, so that it is simple for the control device to convert the position of the slide to an opening degree.

Preferably, the control device is connected with at least one pressure difference detection device, which determines a pressure difference across the valve arrangement provided with the opening degree sensor. When the remaining characteristics of the valve arrangement are known, the opening degree and the pressure difference permit the determination of the flow amount. However, the flow amount of the hydraulic fluid is decisive for the speed, with which the hydraulic consumer, connected to the working connection arrangement, can be activated. Depending on which valve arrangement is provided with the opening degree sensor and the pressure difference detection device, the inlet (metering-in) or the outlet (metering-out) can be accurately controlled.

Preferably, each working connection is provided with a pressure sensor, each pressure sensor being connected with the control device. This results in further control possibilities. The hydraulic consumer can be controlled by means of the pressure at the working connections.

It is preferred that the pressure sensors form part of the pressure difference detection device. In a manner of speaking, the pressure sensors have two purposes, namely the detection of a pressure difference and the detection of an absolute pressure. The control device then detects the pressure difference by means of a third pressure sensor.

Preferably, the control device uses one valve arrangement for controlling a flow through the working connection and the other valve arrangement for controlling a pressure in the working connection arrangement. Thus, in dependence of the location of the individual sensors and the valve arrangements being controlled, an outlet amount control in connection with an inlet pressure control (meter-out flow control and meter-in pressure control) or an inlet amount control and an outlet pressure control (meter-in flow control and meter-out pressure control) can be realised. In both cases, the speed of the hydraulic consumer can be set within a large range, independently of the ruling loads.

In a first embodiment, it is ensured that, with the second valve arrangement, the control device controls the outlet from one working connection, and with the first valve arrangement controls the pressure in one working connection with a positive load on the consumer and in the other working connection with a negative load on the consumer. Thus, the outlet amount control and inlet pressure control can be realised in a simple manner, both with positive and with negative loads. Negative loads mean loads, which act in the movement direction of the consumer. When, for example, the consumer is a hydraulic piston-cylinder unit, which lowers a lifted load, the load acts in the movement direction of the consumer, so that in this case, the pressure is controlled in the working connection, whose outlet amount is not controlled. Here, and in the following, pressure control must be understood so that the ruling pressure must be brought into accordance with a predetermined pressure. Of course, the actual pressure can also be determined by means of measuring in both working connections.

In an alternative embodiment, it is ensured that with the first valve arrangement the control device controls the inlet to one working connection and with the second valve arrangement controls the pressure in the same working connection. In this case, the inlet amount control can be realised in combination with an outlet pressure control. This control acts in the same manner with both positive and negative loads.

Preferably, a third valve arrangement is located between the two working connections, which either blocks or releases a connection between the two working connections. The release can be complete or partial. The third valve arrangement involves additional advantages. When, for example when lowering a load, the third valve arrangement is opened, the fluid to the working connection, which is connected with an expanding working chamber in the consumer, no longer has to be provided through the pressure connection. On the contrary, the fluid flowing out of the other working connection can be returned, which results in an energy-saving operation.

It is preferred that the consumer has different fluid needs from the two connections and that the control device has a coupling device, which connects the activation of the third valve arrangement with an activation of the first or the second valve arrangement. For example, hydraulic actuators in the form of piston-cylinder units with a merely unilaterally extended piston rod have two pressure chambers, whose cross-sectional faces have different designs. The cross-sectional face of the pressure chamber, in which the piston rod is located, is smaller than the cross-sectional face of the pressure chamber, in which no piston rod is located. Accordingly, when retracting the piston rod into the cylinder, an outlet amount from the pressure chamber without piston rod occurs, which is larger than the inlet amount to the pressure chamber with piston rod. The surplus amount of fluid can be discharged via the second valve arrangement. When, however, during the lowering of a load, the pressure chamber with the piston rod is reduced, a larger amount of fluid has to be supplied to the pressure chamber without piston rod. In this case, also the first valve arrangement is activated.

Preferably, a floating position can be set, in which the third valve arrangement connects the two working connections with each other and the second valve arrangements connects one of the two working connections with the tank connection. In many applications it is necessary to connect both working connections with the tank connection simultaneously to achieve a free movability of the hydraulic consumer. This floating position can easily be set in the shown manner.

Preferably, only three pressure sensors are provided, of which two determine the pressure in the working connections and one determines the pressure at either the pressure connection or the tank connection. Thus, a relatively small number of sensors will be sufficient. Of course, it is possible to provide mounting space for additional sensors in the housing of the valve arrangement. These can be made with reasonable effort. Depending on the desired purpose (meter-in or meter-out) the individual pressure sensors can then be mounted.

It is also advantageous, when only one opening degree sensor is provided, which is located at the first valve arrangement or at the second valve arrangement. Here, the same conditions apply than for the pressure sensors. A relatively small number of sensors will be sufficient, also when additional mounting space can be provided to improve the flexibility of the valve arrangement.

Preferably, all working connections are located on the same side of a housing accommodating the valve arrangement. This makes it possible to place the piping for the connections on the same side of the valve. Thus, a simple housing design can be realised.

BRIEF DESCRIPTION OF THE DRAWINGS

In the following, the invention is described in detail on the basis of preferred embodiments in connection with the drawings, showing.

DETAILED DESCRIPTION OF THE PREFERRED EMBODIMENTS

Figure 1:
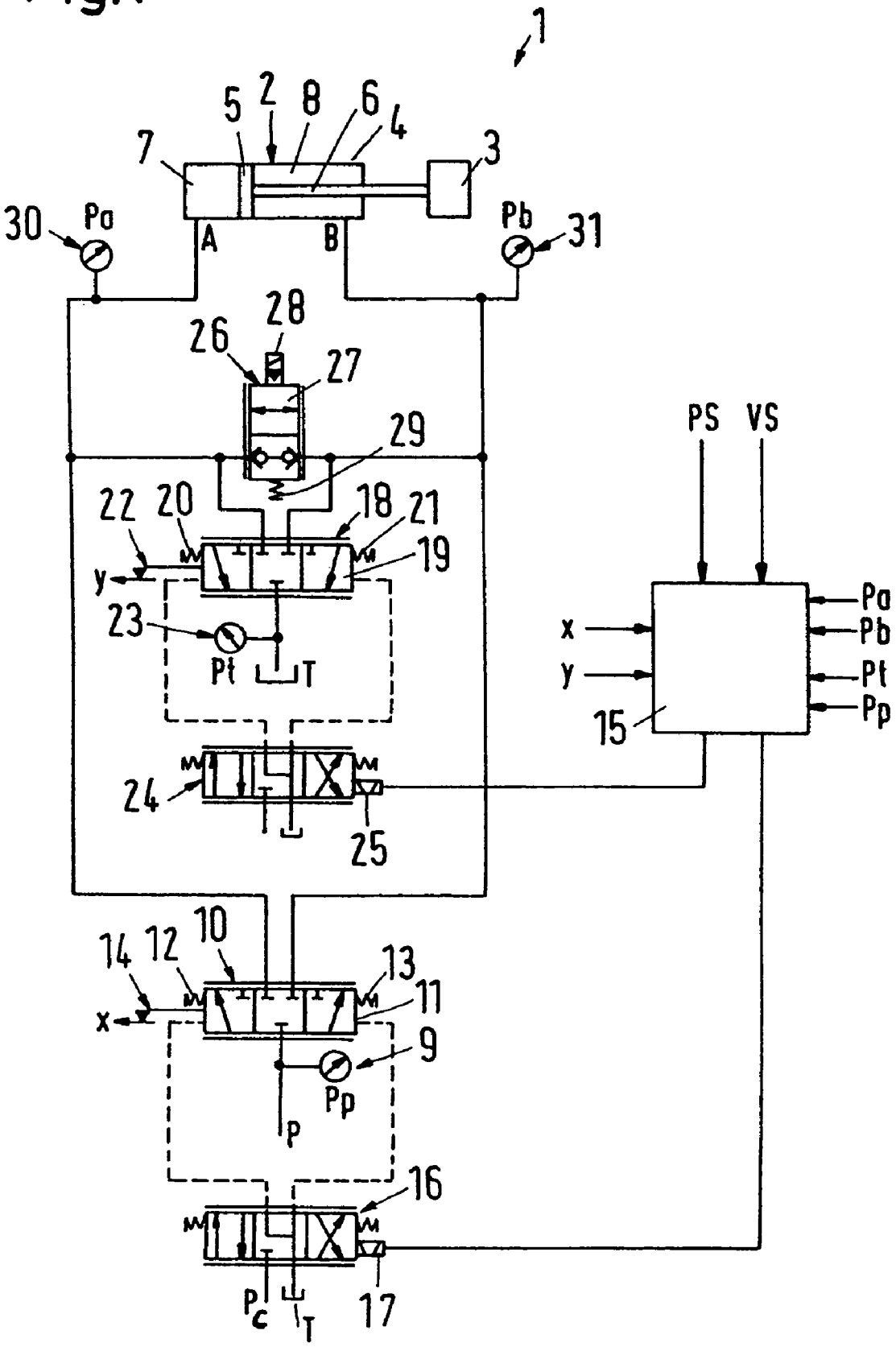
FIG. 1 is a schematic view of a hydraulic valve arrangement

A hydraulic valve arrangement 1 has two working connections A, B, which are connected with a hydraulic consumer 2. In this case, the hydraulic consumer 2 is a piston-cylinder unit, which lifts a load 3. For example, a piston-cylinder unit is used on a tractor to form a lifting device for a plough or another tool.

The consumer has a cylinder 4, in which a piston 5 is located. On one side, the piston 5 is connected with a piston rod 6, which again acts upon the load 3. Accordingly, a first pressure chamber 7 occurs, with a cross-sectional face, which is larger than the cross-sectional face of a second pressure chamber 8. The first pressure chamber 7 is connected with the working connection A. The second working chamber 8 is connected with the working connection B.

The pressure required to control the consumer is supplied via a pressure connection P, which can be connected with pump or another pressure source, not shown in detail. At the pressure connection P is located a pressure sensor 9, which determines a pressure Pp, that is, the pressure at the pressure connection.

In FIG. 1, pressure sensors are shown in all possible positions, in which they could in principle be mounted. As explained below, however, pressure sensors in all the positions shown are not actually required for the operation of the valve arrangement. Expediently, however, accommodation for a pressure sensor will be provided in all these positions.

Via a first valve arrangement 10, the pressure connection P is connected with the two working connections A, B. The first valve arrangement 10 has the form of a slide valve with a slide 11 held in its neutral position by springs 12, 13, in which neutral position a connection between the pressure connection P and the two working connections A, B is interrupted. When the slide 11 is displaced, the first valve arrangement creates a connection either between the pressure connection P and one working connection A or between the pressure connection P and the other working connection B.

A position sensor 14 determines the position of the slide 11. As the position of the slide 11 is at the same time provides an expression of the opening degree or the opening width of the first valve arrangement, the position sensor 14 is also called opening degree sensor 14. The opening degree sensor 14 generates a signal x, which is led to a control device 15.

The first valve arrangement 10 is pilot-valve controlled, that is, a pilot valve 16 is provided, which has a magnet drive 17 or another drive, which is controlled by the control device 15. The pilot valve 16 leads pressure from a control pressure connection Pc to the first frontside of the slide 11 and connects the second frontside of the slide 11 with the tank connection. In this case, the slide 11 is moved in one direction. Or the pilot valve 16 connects the second frontside with the pressure connection P and the first frontside with the tank connection T. In this case, the slide 11 is moved in the other direction. When the pilot valve 16 is in the shown neutral position, the slide 11 is also moved to the shown neutral position.

The flow through the first valve arrangement 10 will therefore always have the same direction, independently of which of the two working connections A, B is acted upon by pressure.

A second valve arrangement 18 has a similar design, that is, it has a slide 19, which is held in the shown neutral position by springs 20, 21. The second valve arrangement has a position sensor 22, which emits a signal y, which indicates the position of the slide 19 in the second valve arrangement 18 and thus the opening degree. Also this signal is led to the control device 15.

When the slide 19 has been moved from its neutral position, the second valve arrangement 18 connects the tank connection T with either the first working connection A or the second working connection B. In the shown neutral position of the slide 19, however, the connection is completely interrupted.

In the tank connection T a pressure sensor 23 is located, which determines a pressure Pt and reports it to the control device 15.

Also the second valve arrangement 18 is pilot-controlled, that is, a pilot valve 24 is provided, whose magnet drive 25 or another drive is activated by the control device 15 to displace the slide during the control of hydraulic pressures.

In the working connection A a pressure sensor 30 is located, which determines a pressure Pa. In the working connection B a pressure sensor 31 is located, which detects a pressure Pb. Thus, the pressure sensors 30, 31 determine the pressures ruling at the working connections A, B, respectively, and report them to the control device 15.

With the valve arrangement shown, different modes of operation are possible. The sensors required will appear from the following description.

In principle, there are two ways of operating the valve arrangement 1. In order to simplify the following explanation, it is assumed that the second working connection B is supplied with fluid under pressure, while from the first working connection A fluid will flow back to the tank connection T.

A first way is to control the fluid flowing off and the pressure at the working connection B, which is supplied with fluid. In this case, the movement speed of the consumer 2, in the present case the movement of the load 3, can be controlled in that the second valve arrangement 18 is controlled. The pressure level in the consumer 2 is controlled by the first valve arrangement 10.

In this case, a pressure sensor 23 should be located in the tank connection T. This pressure sensor 23 permits the control device 15, together with the pressure signal Pa of the pressure sensor 30, to determine a pressure difference over the second valve arrangement 18. Also the position or opening degree sensor 22 is used, which permits a statement on the opening degree of the second valve arrangement 18. Knowing the pressure difference over the second valve arrangement 18 and the opening degree now permits a determination of the volume flow from the pressure chamber 7 via the first working connection. Of course, additional factors must be part of this determination, which are, however, constant or at least known, in the second valve arrangement 18.

With this "meter-out flow control" and "meter-in pressure control", merely three pressure sensors 23, 30, 31 and one position sensor 22 are required. The pressure sensor 31 is also required for the reverse movement of the consumer 2.

With a positive load 3, that is, when the force of the load 3 acts in a different direction than the movement of the piston 5, the opening degree of the first valve arrangement 10 is controlled so that the desired pressure occurs at the first working connection A. This desired pressure and/or a desired speed of the load 3, and thus a desired volume flow, are specified to the control device 15 via control inputs PS or VS, respectively, for example via joystick.

Alternatively, of course also the position of the first valve arrangement 10, or rather the position of the slide 11, can be controlled in dependence of the pressures Pa, Pb ruling in the two working connections A, B, when the corresponding desired pressures have been specified.

With negative loads, that is, when the force of the load 3 acts in the same direction as the movement of the piston 5, the opening degree of the first valve arrangement 10, that is, the position of the slide 11, is set in dependence of the desired pressure level in the working connection B and the measured pressure Pb in the second working connection B. Alternatively, the position of the slide in the first working connection 10 can also be controlled on the basis of the desired pressure levels Pa, Pb in the two working connections A, B and the measured pressure levels.

An alternative operation mode uses the control of the inlet and the control of the outlet, that is, "meter-in flow control" and "meter-out pressure control". In this case, the first valve arrangement 10 controls the speed of the consumer 2, and the second valve arrangement 18 controls the pressure level at the consumer.

In this case, the pressure sensor 9 at the pressure connection P and the position sensor 14 at the first valve arrangement 10 should be used. The pressure sensor 23 and the movement sensor 22 are not required here.

Figure 2:
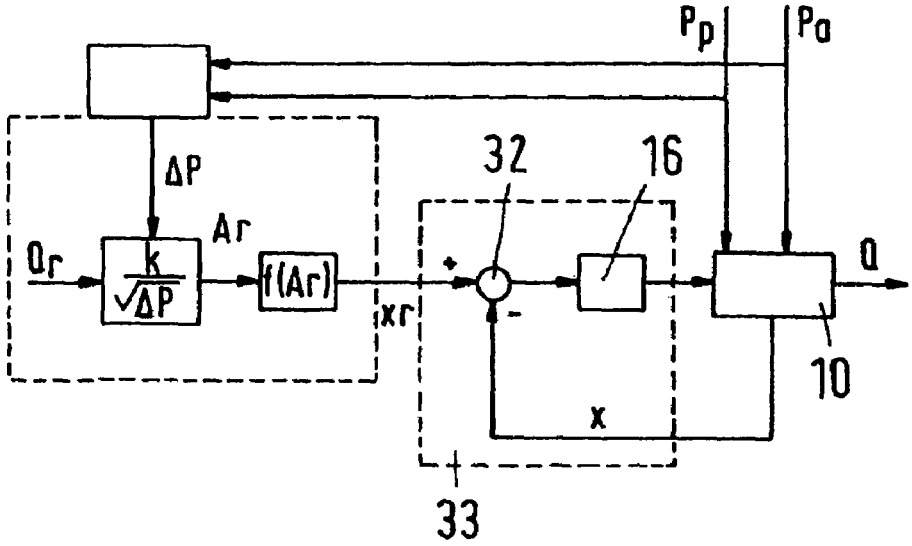
FIG. 2 is a schematic view of controlling the opening degree of a valve

The desired position of the slide 11 is determined on the basis of a pressure difference AP between the pressure Pp at the pressure connection P and the pressure Pa at the first working connection A and a desired volume flow Qr (FIG. 2). The result is a desired flow cross-section Ar for the first valve arrangement 10. Via an accordingly position-dependent valve coefficient this flow cross-section is converted via a function f(Ar) into a position signal xr, which is supplied to an addition point 32, which is part of a controller 33. The addition point 32 is connected with the pilot valve 16, which acts upon the first valve arrangement 10 to change the position of the slide 11, when the actual position x of the slide 11 does not correspond to the predetermined position xr. For reasons of clarity, additional elements of a controller, like control amplifiers etc., are not shown. However, finally a situation occurs, in which the volume flow Q through the first valve arrangement 10 corresponds to a predetermined volume flow Qr. As this volume flow Q at the same time contains information about the movement speed of the piston 5 in the consumer 2, it is possible, by means of integration of the volume flow Q or a value dependent thereon, to make a relatively accurate position determination of the piston 5 in the consumer 2 and thus also a position determination for the load 3.

Both with positive and negative loads, the second valve arrangement 18 is used to make the pressure at the second working connection B correspond to a predetermined pressure.

In both operation modes, merely a position sensor 14, 22 is required, namely at the valve arrangement, via which the pressure difference ΔP is determined.

Between the two working connections A, B a third valve arrangement 26 is located, whose slide 27 is moved directly by a magnet drive 28. In the resting position shown, which is set by a spring 29, the third valve arrangement 26 interrupts a connection between the two working connections A, B, or it connects the two working connections A, B, when the slide 27 is switched to its not shown position.

This third valve arrangement 26 is optional, meaning that it is not necessarily required. However, it has the advantages described below.

In connection with a negative load, a regenerative function can be realised. When, for example, the load 3 is lowered (moved from the right to the left in FIG. 1), the fluid flowing off from the pressure chamber 7 can be supplied to the pressure chamber 8 again. As the pressure chamber 8 does not expand to the same extent than the reduction of the pressure chamber 7, a surplus of fluid occurs, which has to be discharged via the valve arrangement 18. When the conditions are reversed, that is, with a negative load the pressure chamber 7 expands faster than the pressure chamber 8, fluid would accordingly be supplied via the first valve arrangement 10. With a consumer with differently large pressure contact faces, the control device (15) thus always controls the third valve arrangement 26 together with either the first valve arrangement 10 or the second valve arrangement 18.

In the first case, that is, when the valve arrangement 18 is controlled, the position sensor 22 and the pressure sensor 30 are expediently used together with the pressure sensor 23.

When the pressure chamber 7 expands faster than the pressure chamber 8 is reduced, the first valve arrangement 10 is activated together with the third valve arrangement 26. In the case, the position sensor 14, the pressure sensor 30 and the pressure sensor 9 would be used.

In many applications, it is necessary to connect both working connections A, B with the tank connection T at the same time, to achieve pressure-free working connections A, B. In the present case, this is relatively simple, when the two working connections A, B are connected by means of the third valve arrangement 26, and, at the same time, the two working connections A, B are connected with the tank T by means of the second valve arrangement 18.

Particularly when using the valve arrangement on a tractor or another agricultural vehicle, the realisation of a half-floating function may be required. Such a function is, for example, required, when the tractor pulls a plough that has to work in a certain working depth. When such a plough hits a stone or another obstacle, it must be possible to lift it without significant resistance to this movement (of course except for the weight forces). After overcoming the obstacle, the plough shall be able to return to its previously set working depth.

In the present case, this is relatively simply realised. Again, it is assumed that the pressure at the working connection A serves the purpose of lifting the load 3, in this case a plough. Here, the second valve arrangement 18 is used as pressure control valve. When the pressure Pb at the second working connection B exceeds a limit value, because the plough is pushed out of the earth by an obstacle, the second pressure connection 18 creates a connection between the second working connection B and the tank connection T, so that fluid can be displaced from the second pressure chamber 8. By means of the first valve arrangement 10, the fluid amount required to lift the load 3 is supplied to the first pressure chamber 7. In this case, the control device 15 determines the opening degree of the first valve arrangement 10 and the period, during which the first valve arrangement 10 has assumed this opening degree, and the pressure difference ΔP over the first valve arrangement 10. The control device 15 is thus able to determine the position change of the load 3 relatively accurately.

When the pressure Pb at the second working connection B again drops below the limit value, the piston 5 is again moved in the opposite direction to lower the load 3. In this case, fluid is supplied from the pressure connection P via the first valve arrangement 10. Via the second valve arrangement 18, the fluid is discharged from the first pressure chamber 7. In this case, the control device 15 now practically merely has to drive the valve arrangement 10 back-to-front, that is, hold the slide 11 in the opposite direction for the same period as previously, when the load 3 was lifted. Such an operation mode is relatively easily realised. When the desired position of the load 3 is reached, the movement is stopped. Of course, a position sensor can also still be used.

In this way it is possible for the consumer 2 always to hold a certain load in position, for as long as no external forces lift the load 3.

Figure 3:
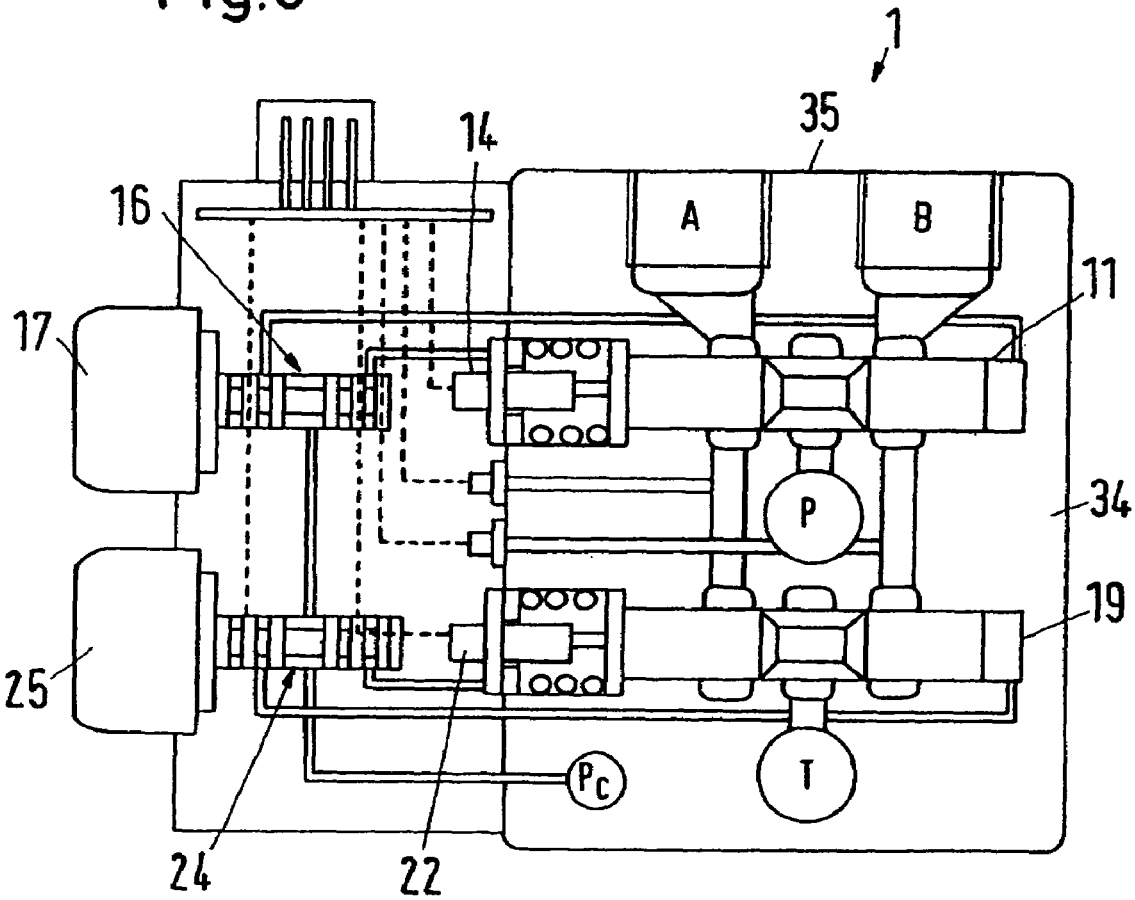
FIG. 3 is a schematic view of the design of a valve arrangement

FIG. 3 is a schematic view of the mechanical design of such a valve arrangement 1. Same elements have the same reference numbers as in FIG. 1.

In a housing 34, the slides 11 and 19 are arranged to be parallel to each other. The two working connections A, B are located at the same frontside 35 of the housing 34, which simplifies the mounting of connection pipes.

With the valve arrangement described and the operation modes shown, the following advantages occur: The valve topology is based on independently controllable, separate measuring orifices, which are realised by means of the first valve arrangement 10 or the second valve arrangement 18, respectively. Thus, the speed, with which the consumer 2 is operated, and the pressure level, under which the consumer 2 works, can be set substantially independently of each other.

With a simple operation mode, merely one single position sensor is required. Only, when the third valve arrangement 26 is used with the floating or the half-floating operation modes, it may be expedient to have two position sensors.

By means of the valve arrangement, it is possible, in a simple manner, to achieve a half-floating operation, that is, to let the load 3 be moved only in one single direction under the influence of external forces, whereas a movement in another direction is blocked. Usually, this is only possible with single-acting hydraulic cylinders, which are traditionally used for toolbars on tractors. When, here, a double-acting cylinder is used, also other functions can be achieved by means of the toolbar, for example a lifting of the tractor.

The third valve arrangement 26 permits an easy management of negative loads, without requiring additional oil amounts from the pump connection P.

What is claimed is:

1. A hydraulic valve arrangement comprising: a working connection arrangement having a first working connection and a second working connection, the first and the second working connections being connectable with a hydraulic consumer; a supply connection arrangement having a pressure connection and a tank connection, a first valve arrangement operable to accomplish at least one of closing the pressure connection and connecting the pressure connection in a controlled manner with one of the first working connection and the second working connection, a second valve arrangement, operable to accomplish at least one of closing the tank connection and connecting the tank connection in a controlled manner with at least one of the first working connection and the second working connection, and a control device, which controls the first valve arrangement and the second valve arrangement, being at least one of the valve arrangements being provided with an opening degree sensor, connected with the control device, and wherein the control device controls the valve arrangement in dependence on the signal received from the opening degree sensor and a specified signal (PS, VS).

2. A hydraulic valve arrangement according to claim 1, wherein the valve arrangement is in the form of a slide valve, and the opening degree sensor is a position sensor, which determines a position of a slide.

3. A hydraulic valve arrangement according to claim 2, wherein the control device evaluates a non-linear correlation between the position of the slide and the opening degree of the valve arrangement.

4. A hydraulic valve arrangement according to claim 1, wherein the control device is connected with at least one pressure difference detection device, which determines a pressure difference across the valve arrangement provided with the opening degree sensor.

5. A hydraulic valve arrangement according to claim 1, wherein each working connection is provided with a pressure sensor, and each pressure sensor being connected with the control device.

6. A hydraulic valve arrangement according to claim 5, wherein the pressure sensors form part of the pressure difference detection device.

7. A hydraulic valve arrangement according to claim 1, wherein the control device uses one valve arrangement for controlling a flow through the working connection arrangement and the other valve arrangement for controlling a pressure in the working connection arrangement.

8. A hydraulic valve arrangement according to claim 7, wherein the control device and the second valve arrangement controls an outlet from one working connection, and with the first valve arrangement controls the pressure in one working connection with a positive load on the consumer and in the other working connection with a negative load on the consumer.

9. A hydraulic valve arrangement according to claim 7, wherein in conjunction with the first valve arrangement the control device controls the inlet to one working connection and with the second valve arrangement controls the pressure in the same working connection.

10. A hydraulic valve arrangement according to claim 1, wherein at least one valve arrangement can be activated by a pilot valve.

11. A hydraulic valve arrangement according to claim 1, wherein a third valve arrangement is located between the two working connections, which perform one of blocking and releasing a connection between the two working connections.

12. A hydraulic valve arrangement according to claim 11, wherein the consumer has different fluid needs from the two working connections and that the control device has a coupling device, which connects the activation of the third valve arrangement with an activation of the first or the second valve arrangement.

13. A hydraulic valve arrangement according to claim 11, wherein a floating position can be set, in which the third valve arrangement connects the two working connections with each other and the second valve arrangements connects one of the two working connections with the tank connection.

14. A hydraulic valve arrangement according to claim 1, wherein only three pressure sensors are provided, of which two determine the pressure in the working connections and one determines the pressure at either the pressure connection or the tank connection.

15. A hydraulic valve arrangement according to claim 1, wherein only one opening degree sensor is provided and is located at one of the first valve arrangement and the second valve arrangement.

16. A hydraulic valve arrangement according to claim 1, wherein all working connections are located on the same side of a housing accommodating the valve arrangement.

* * * * *